US005322273A

United States Patent [19]

Rapkin et al.

[11] Patent Number: 5,322,273

[45] Date of Patent: Jun. 21, 1994

[54] SHEET REGISTRATION MECHANISM

[75] Inventors: Alan E. Rapkin, Fairport; Wayne W. Forrest, Rochester; Richard G. Luther, Hamlin; Vidanand Chand, Rochester, all of N.Y.

[73] Assignee: Eastman Kodak Company, Rochester, N.Y.

[21] Appl. No.: 63,248

[22] Filed: May 18, 1993

[51] Int. Cl.[5] ..... B65H 7/02

[52] U.S. Cl. ..... 271/227; 271/272

[58] Field of Search ..... 271/227, 228, 250, 252, 271/253, 254, 255, 270, 272

[56] References Cited

U.S. PATENT DOCUMENTS

| | | | |
|---|---|---|---|
| 4,334,759 | 6/1982 | Clausing | 355/3 SH |
| 4,799,084 | 1/1989 | Koike et al. | 355/14 SH |
| 4,805,892 | 2/1989 | Calhoun | 271/225 |
| 4,855,607 | 8/1989 | Eckl . | |
| 4,971,304 | 11/1990 | Lofthus | 271/227 |
| 5,078,384 | 1/1992 | Moore | 271/228 |
| 5,094,442 | 3/1992 | Kamprath et al. | 271/227 |
| 5,156,391 | 10/1992 | Roller | 271/227 |
| 5,169,140 | 12/1992 | Wenthe, Jr. | 271/228 |
| 5,219,159 | 6/1993 | Malachowski et al. | 271/228 |

FOREIGN PATENT DOCUMENTS

| | | | |
|---|---|---|---|
| 0198952 | 8/1990 | Japan | 271/228 |

*Primary Examiner*—H. Grant Skaggs
*Attorney, Agent, or Firm*—Lawrence P. Kessler

[57] ABSTRACT

A sheet registration mechanism for aligning a sheet moving along a substantially planar transport path relative to such transport path in a plurality of orthogonal directions (e.g., the cross-track and in-track directions and remove skew). The mechanism comprises a first roller assembly having a first urging roller mounted for rotation about an axis lying in a plane parallel to the plane of the transport path, and substantially perpendicular to the direction of sheet travel along the transport path. A second roller assembly has a second urging roller mounted for rotation about an axis lying in a plane parallel to the plane of the transport path, and substantially perpendicular to the direction of sheet travel along the transport path. A third roller assembly has a third urging roller mounted for rotation about an axis lying in a plane parallel to the plane of the transport path, and substantially perpendicular to the direction of sheet travel along the transport path. The third urging roller is also movable along its axis of rotation in a direction transverse to the transport path. A control, operatively associated respectively with the first, second and third roller assemblies, selectively controls rotation of the first and second urging rollers to align a moving sheet in a direction perpendicular to the plane of the transport path, and selectively controls rotation of the third urging roller and transverse movement of the third urging roller to respectively align such moving sheet in the direction of travel along the transport path and in the direction transverse to the transport path.

35 Claims, 5 Drawing Sheets

SHEET REGISTRATION MECHANISM

BACKGROUND OF THE INVENTION

The present invention relates in general to a mechanism for registering sheets, for example transported seriatim along a travel path, and more particularly, to a sheet registration mechanism which aligns individual sheets in a plurality of orthogonal directions (e.g., cross-track, in-track, and skew directions relative to the sheet travel path).

In conventional reproduction apparatus, such as printers and copier/duplicators, for example, information is reproduced on receiver members. Typically, the receiver members are cut sheets of plain paper or transparency material. Such receiver member material is transported through the reproduction apparatus in association with various process elements of the reproduction apparatus to have an information reproduction formed thereon. It is important in forming the desired information reproduction that the association of the receiver member be accurately registered relative to the process elements to generate a reproduction which is acceptable to the user.

In recent advanced reproduction apparatus, a method of operation has been provided wherein multiple images can be sequentially placed on a single receiver member. For example, supplemental information can be added to base information to be copied. The supplemental information may be, for example, of a different color from the base information so that the supplemental information stands out on the reproduction. Alternatively, the supplemental information may be a highlight strip overlying the base information to accentuate a portion of the base information. In such instances of placing multiple sequential images on a receiver member, alignment of the receiver member as it travels on each pass through the reproduction apparatus is even more critical than it is when only one information image is to be placed on the receiver member.

In order to accomplish desired registration of the receiver member, the reproduction apparatus transport includes various mechanisms acting on the receiver member to align the member, moving along the transport path, in a plurality of orthogonal directions, at various points throughout the path. Such mechanisms may include, for example, friction roller assemblies or drive belts associated with guides and gates. While such arrangements are generally effective in aligning a transported receiver member, extreme care is required in handling the receiver member to prevent damage due to excessive forces moving the member into contact with the guides and gates. Additionally, to align the receiver member in the plurality of orthogonal directions (e.g., the cross-track and in-track directions and remove skew), a complex arrangement is required where the various alignment actions take place sequentially with the member being handed off from one alignment element to the next. This results in a relatively extensive assembly which requires considerable time to accomplish the entire alignment function.

Several recent arrangements have been disclosed which address the reduction of the overall assembly for aligning a transported member in several orthogonal directions (i.e., the cross-track, in-track, or skew directions). U.S. Pat. No. 4,799,084 (issued Jan. 17, 1989, in the names of Koike et al) shows a transport roller assembly which is mounted such that at a selected time such roller assembly is movable by a cam and follower mechanism in a lateral direction to provide cross-track alignment. U.S. Pat. No. 4,805,892 (issued Feb. 21, 1989, in the name of Calhoun) shows a sheet transport assembly where a roller assembly pair is axially movable to bring an in-track edge of a sheet to a predetermined position for cross-track alignment. U.S. Pat. No. 5,078,384 (issued Jan. 7, 1992, in the name of Moore) describes an arrangement where selectably controllable drive rolls cooperating with sheet skew and lead edge sensors drive and deskew sheets. None of the apparatus disclosed in these patents accomplishes alignment of a transported member in all of the orthogonal directions as defined above.

U.S. Pat. No. 5,094,442 (issued Mar. 10, 1992, in the names of Kamprath et al) shows a registration apparatus having independent variable speed drive roller assemblies which are supported by an assembly movable transversely to the direction of sheet movement. While the apparatus of this patent can accomplish alignment of a transported member in the cross-track, in-track, and skew directions, it is of a complex nature requiring the entire apparatus to be moved in the transverse direction.

SUMMARY OF THE INVENTION

In view of the foregoing discussion, this invention is directed to a sheet registration apparatus for aligning a sheet moving along a transport path relative to such transport path in a plurality of orthogonal directions (e.g., the cross-track and in-track directions and remove skew). The apparatus comprises a first roller assembly having a first urging roller mounted for rotation about an axis lying in a plane parallel to a plane taken through said transport path, and substantially perpendicular to the direction of the transport path. A second roller assembly has a second urging roller mounted for rotation about an axis lying in a plane parallel to a plane taken through the transport path, and substantially perpendicular to the direction of the transport path. A third roller assembly has a third urging roller mounted for rotation about an axis lying in a plane parallel to a plane taken through the transport path, and substantially perpendicular to the direction of the transport path. The third urging roller is also movable along its axis of rotation in a direction transverse to the transport path. A control, operatively associated respectively with the first, second and third roller assemblies, selectively controls rotation of the first and second urging rollers to align a moving sheet in a direction perpendicular to the plane through the transport path, and selectively controls rotation of the third urging roller and transverse movement of the third urging roller to respectively align such moving sheet in the direction of travel along the transport path and in the direction transverse to the transport path.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
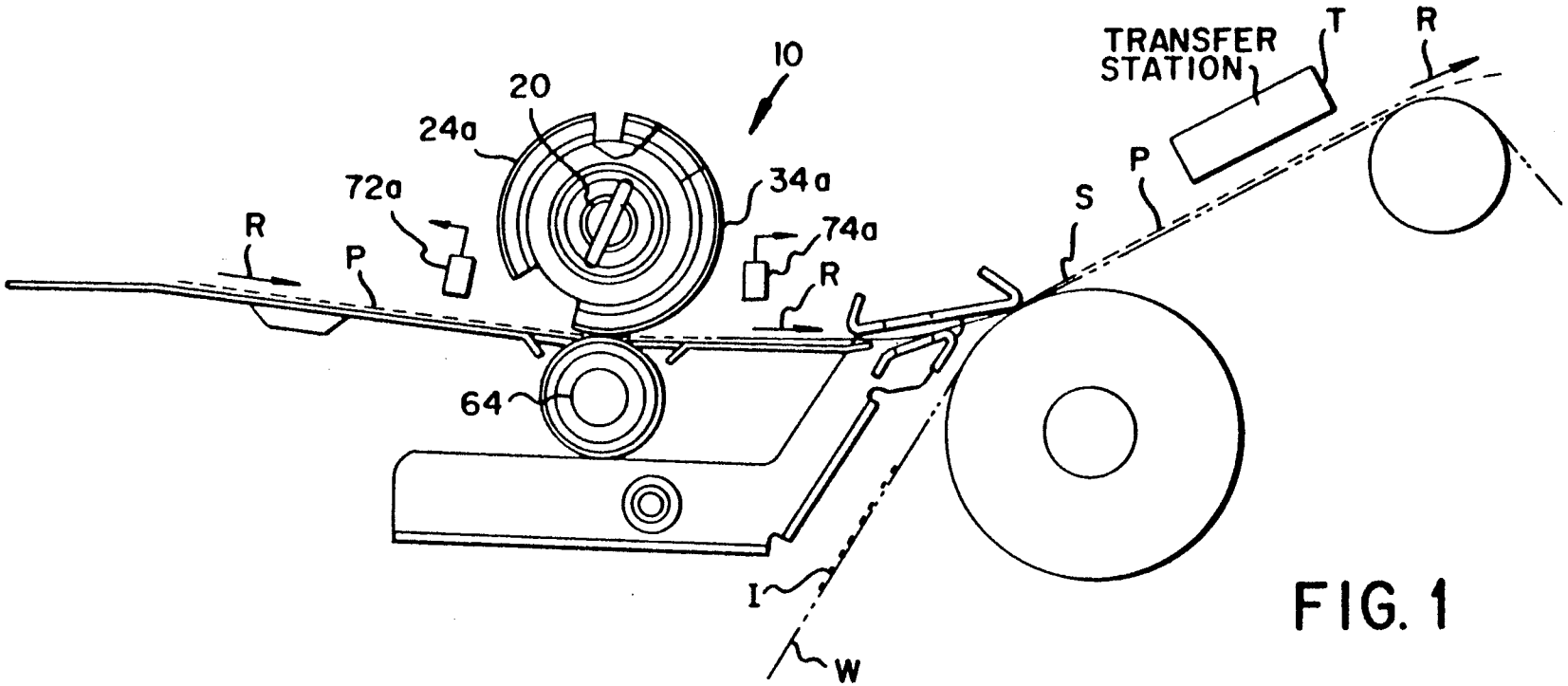
FIG. 1 is a side elevational view of the sheet registration mechanism, according to this invention, partly in cross-section, and with portions removed to facilitate viewing.
Figure 8:
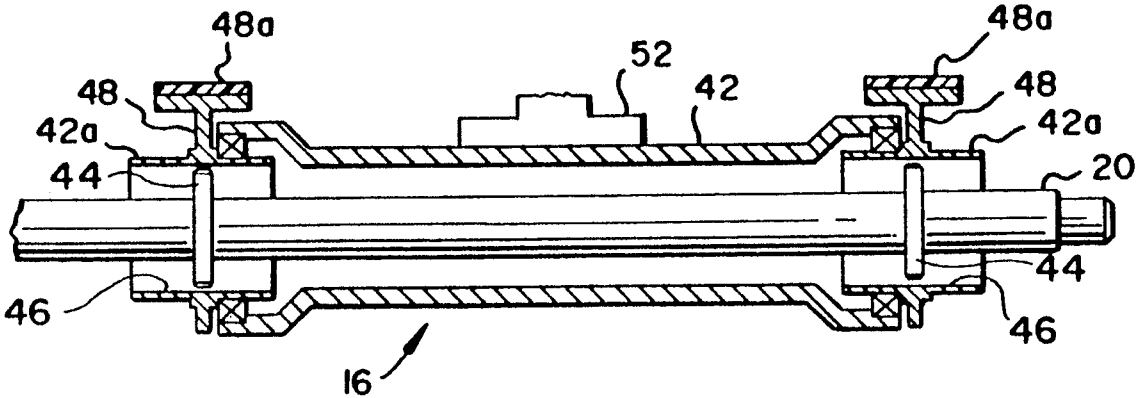
FIG. 8 front elevational view, in cross-section of the third roller assembly of the sheet registration mechanism according to this invention.
Figure 2:
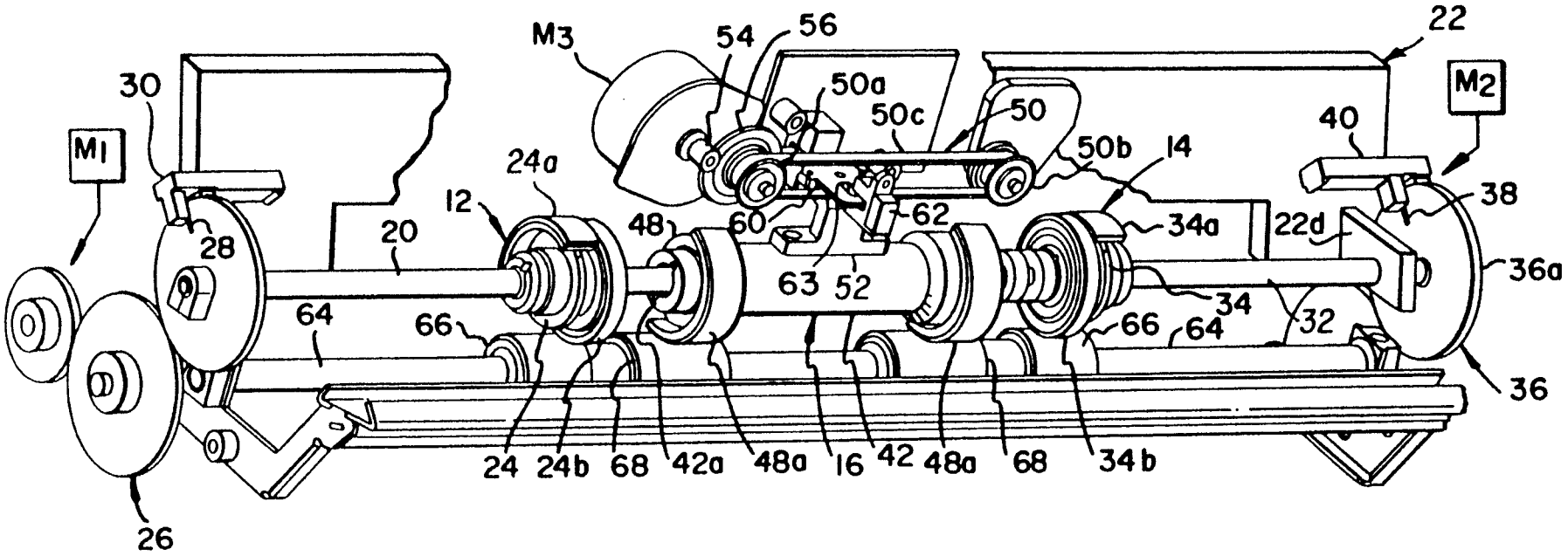
FIG. 2 is a view, in perspective, of the sheet registration mechanism of FIG. 1, with portions removed or broken away to facilitate viewing.
Figure 3:
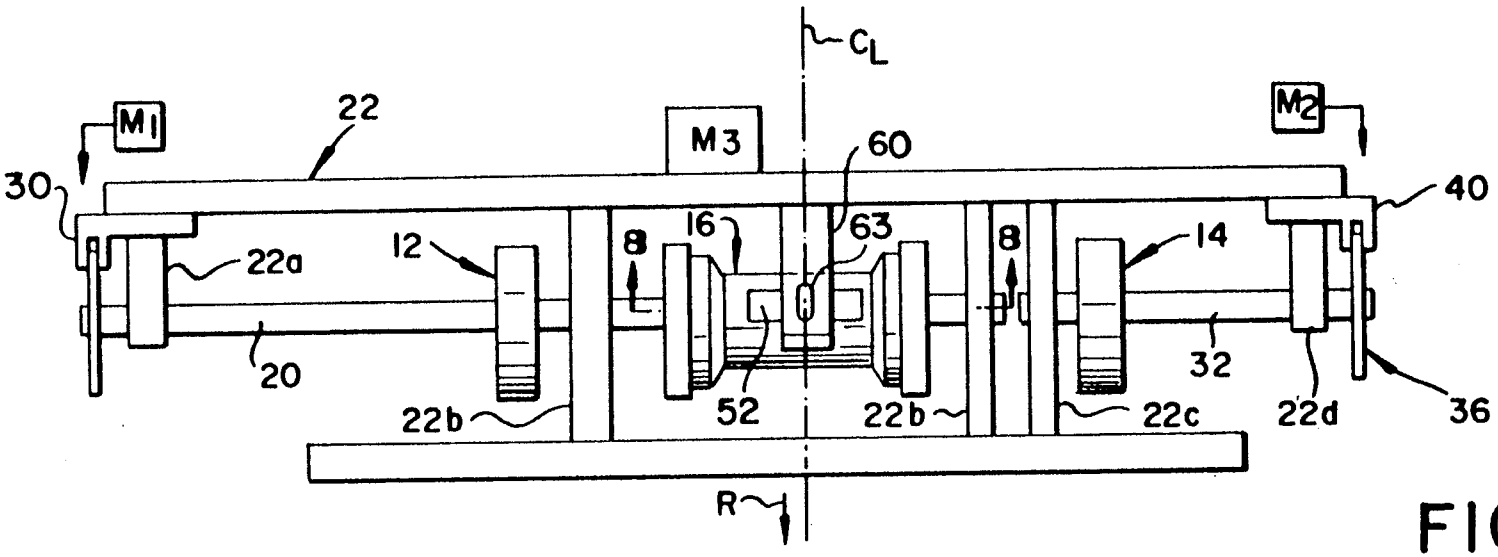
FIG. 3 is a top plan view of the sheet registration mechanism of FIG. 1, with portions removed or broken away to facilitate viewing.

Referring now to the accompanying drawings, FIGS. 1–3 best show the sheet registration mechanism, designated generally by the numeral 10, according to this invention. The sheet registration mechanism 10 is located in association with a substantially planar sheet transport path P of any well known device where sheets are transported seriatim from a supply (not shown) to a station where an operation is performed on the respective sheets. For example, the device may be a reproduction apparatus, such as a copier or printer or the like, where marking particle developed images of original information,, are placed on receiver sheets. As shown in FIG. 11, the marking particle developed images (e.g., image I) are transferred at a transfer station T from a movable web or drum (e.g., web W) to a sheet of receiver material (e.g., a cut sheet S of plain paper or transparency material) moving along the path P.

In reproduction apparatus of the above type, it is desired that the sheet S be properly registered with respect to a marking particle developed image in order for the image to be placed on the sheet in an orientation to form a suitable reproduction for user acceptability. Accordingly, the sheet registration mechanism 10 provides for alignment of the receiver sheet in a plurality of orthogonal directions. That is, the sheet is aligned, with the marking particle developed image, by the sheet registration mechanism by removing any skew in the sheet (angular deviation relative to the image), and moving the sheet in a cross-track direction so that the centerline of the sheet in the direction of sheet travel and the centerline of the marking particle image are coincident. Further, the sheet registration mechanism 10 times the advancement of the sheet along the path P such that the sheet and the marking particle image are aligned in the in-track direction as the sheet travels through the transfer station T.

In order to accomplish skew correction and cross-track and in-track alignment of the sheet, for example with respect to a marking particle developed image on the moving web W, the sheet registration apparatus 10 according to this invention includes first and second independently driven roller assemblies 12, 14, and a third roller assembly 16. The first roller assembly 12 includes a first shaft 20 supported adjacent its ends in bearings 22*a*, 22*b* mounted on a frame 22. Support for the first shaft 20 is selected such that the first shaft is located with its longitudinal axis lying in a plane parallel to the plane through the sheet transport path P and substantially perpendicular to the direction of a sheet traveling along the transport path in the direction of arrows R (FIG. 1).

A first urging roller 24 is mounted on the first shaft 20 for rotation therewith. The urging roller 24 has an arcuate peripheral segment 24*a* extending about 180° around such roller. The peripheral segment 24*a* has a radius to its surface measured from the longitudinal axis of the first shaft 20 substantially equal to the minimum distance of such longitudinal axis from the plane of the transport path P. A first stepper motor $M_1$, mounted on the frame 22, is operatively coupled to the first shaft 20 through a gear train 26 to rotate the first shaft when the motor is activated. The gear 26*a* of the gear train 26 incorporates an indicia 28 detectable by a suitable sensor mechanism 30. The sensor mechanism 30 can be either optical or mechanical depending upon the selected indicia. Location of the sensor mechanism 30 is selected such that when the indicia 28 is detected, the first shaft 20 will be angularly oriented to position the first urging roller 24 in a home position. The home position of the first urging roller is that angular orientation where the surface of the arcuate peripheral segment 24*a* of the roller 24, upon further rotation of the shaft 20, will contact a sheet in the transport path P (see FIG. 7*a*).

The second roller assembly 14 includes a second shaft 32 supported adjacent its ends in bearings 22*c*, 22*d* mounted on the frame 22. Support of the second shaft 32 is selected such that the second shaft is located with its longitudinal axis lying in a plane parallel to the plane through the sheet transport path P and substantially perpendicular to the direction of a sheet traveling along the transport path. Further, the longitudinal axis of the second shaft 32 is substantially coaxial with the longitudinal axis of the first shaft 20.

A second urging roller 34 is mounted on the second shaft 32 for rotation therewith. The urging roller 34 has an arcuate peripheral segment 34*a* extending about 180° around such roller. The peripheral segment 34*a* has a radius to its surface measured from the longitudinal axis of the first shaft 20 substantially equal to the minimum distance of such longitudinal axis from the plane of the transport path P. The arcuate peripheral segment 34*a* is angularly coincident with the arcuate peripheral segment 24*a* of the urging roller 24. A second independent stepper motor $M_2$, mounted on the frame 22, is operatively coupled to the second shaft 32 through a gear train 36 to rotate the second shaft when the motor is activated. The gear 36*a* of the gear train 36 incorporates an indicia 38 detectable by a suitable sensor mechanism 40. The sensor mechanism 40, adjustably mounted on the frame 22, can be either optical or mechanical depending upon the selected indicia. Location of the sensor mechanism 40 is selected such that when the indicia 38 is detected, the second shaft 32 will be angularly oriented to position the second urging roller 34 in a home position. The home position of the second urging roller is that angular orientation where the surface of the arcuate peripheral segment 34*a* of the roller 34, upon further rotation of the shaft 32, will contact a sheet in the transport path P (same as the angular orientation of the peripheral segment 24*a* shown in FIG. 7*a*).

The third roller assembly 16 includes a tube 42 surrounding the first shaft 20 and capable of movement relative to the first shaft in the direction of the longitudinal axis thereof. A pair of third urging rollers 48 are mounted on the first shaft 20, supporting the tube 42 for relative rotation with respect to the third urging rollers. The third urging rollers 48 respectively have an arcuate peripheral segment 48*a* extending about 180° around each roller. The peripheral segments 48*a* each have a radius to its respective surface measured from the longitudinal axis of the first shaft 20 substantially equal to the minimum distance of such longitudinal axis from the plane of the transport path P. The arcuate peripheral segments 48*a* are angularly offset with respect to the arcuate peripheral segments 24*a*, 34*a* of the first and second urging rollers. The pair of third urging rollers 48 are coupled to the first shaft 20 by a key or pin 44 engaging a slot 46 in the respective rollers. Accordingly, the third urging rollers 48 will be rotatably driven with the first shaft 20 when the first shaft is rotated by the first stepper motor $M_1$, and are movable in the direction along the longitudinal axis of the first shaft with the tube 42. For the purpose to be more fully explained below, the angular orientation of the third urging rollers 48 is such that the arcuate peripheral segments 48*a* thereof are offset relative to the arcuate peripheral segments 24*a* and 34*a*.

A third independent stepper motor $M_3$, mounted on the frame 22, is operatively coupled to the tube 42 of the third roller assembly 16 to selectively move the third roller assembly in either direction along the longitudinal axis of the first shaft 20 when the motor is activated. The operative coupling between the third stepper motor $M_3$ and the tube 42 is accomplished through a pulley and belt arrangement 50. The pulley and belt arrangement 50 includes a pair of pulleys 50*a*, 50*b*, rotatably mounted in fixed spatial relation, for example, to a portion of the frame 22. A drive belt 50*c* entrained about the pulleys is connected to a bracket 52 which is in turn connected to the tube 42. A drive shaft 54 of the third stepper motor $M_3$ is drivingly engaged with a gear 56 coaxially coupled to the pulley 50*a*. When the stepper motor $M_3$ is activated, the gear 56 is rotated to rotate the pulley 50*a* to move the belt 50*c* about its closed loop path. Depending upon the direction of rotation of the drive shaft 54, the bracket 52 (and thus the third roller assembly 16) is selectively moved in either direction along the longitudinal axis of the first shaft 20.

A plate 60 connected to the frame 22 incorporates an indicia 63 detectable by a suitable sensor mechanism 62. The sensor mechanism 62, adjustably mounted on the bracket 52, can be either optical or mechanical depending upon the selected indicia. Location of the sensor mechanism 62 is selected such that when the indicia 63 is detected, the third roller assembly 16 is located in a home position. The home position of the third roller assembly 16 is selected such that the third roller assembly is substantially centrally located relative to the cross-track direction of a sheet in the transport path P.

The frame 22 of the sheet registration mechanism 10 also supports a shaft 64 located generally below the plane of the sheet transport path P. Pairs of idler rollers 66 and 68 are mounted on the shaft 64 for free rotation. The rollers of the idler pair 66 are respectively aligned with the first urging roller 24 and the second urging roller 34. The rollers of the idler roller pair 68 are aligned with the respective third urging rollers 48, and extend in a longitudinal direction for a distance sufficient to accommodate for maintaining such alignment over the range of longitudinal movement of the third roller assembly 16. The spacing of the shaft 64 from the plane of the sheet transport path P and the diameter of the respective rollers of the idler roller pairs 66 and 68 are selected such that the rollers will respectively form a nip relation with the arcuate peripheral segments 24*a*, 34*a*, and 48*a* of the urging rollers. For example, the shaft 64 may be spring loaded in a direction urging such shaft toward the shafts 20, 32, where the idler roller pair 66 will engage spacer roller bearings 24*b*, 34*b*.

With the above described construction for the sheet registration mechanism 10 according to this invention, sheets traveling seriatim along the sheet transport path P are alignable by removing any skew (angular deviation) in the sheet to square the sheet up with respect to the path, and moving the sheet in a cross-track direction so that the centerline of the sheet in the direction of sheet travel and the centerline $C_L$ of the transport path P are coincident. Of course, the centerline $C_L$ is arranged to be coincident with the centerline of the downstream operation station (in the illustrated embodiment, the centerline of a marking particle image on the web W). Further, the sheet registration mechanism 10 times the advancement of the sheet along the transport path P for alignment in the in-track direction (again referring to the illustrated embodiment, in register with the lead edge of a marking particle image on the web W).

Figure 6:
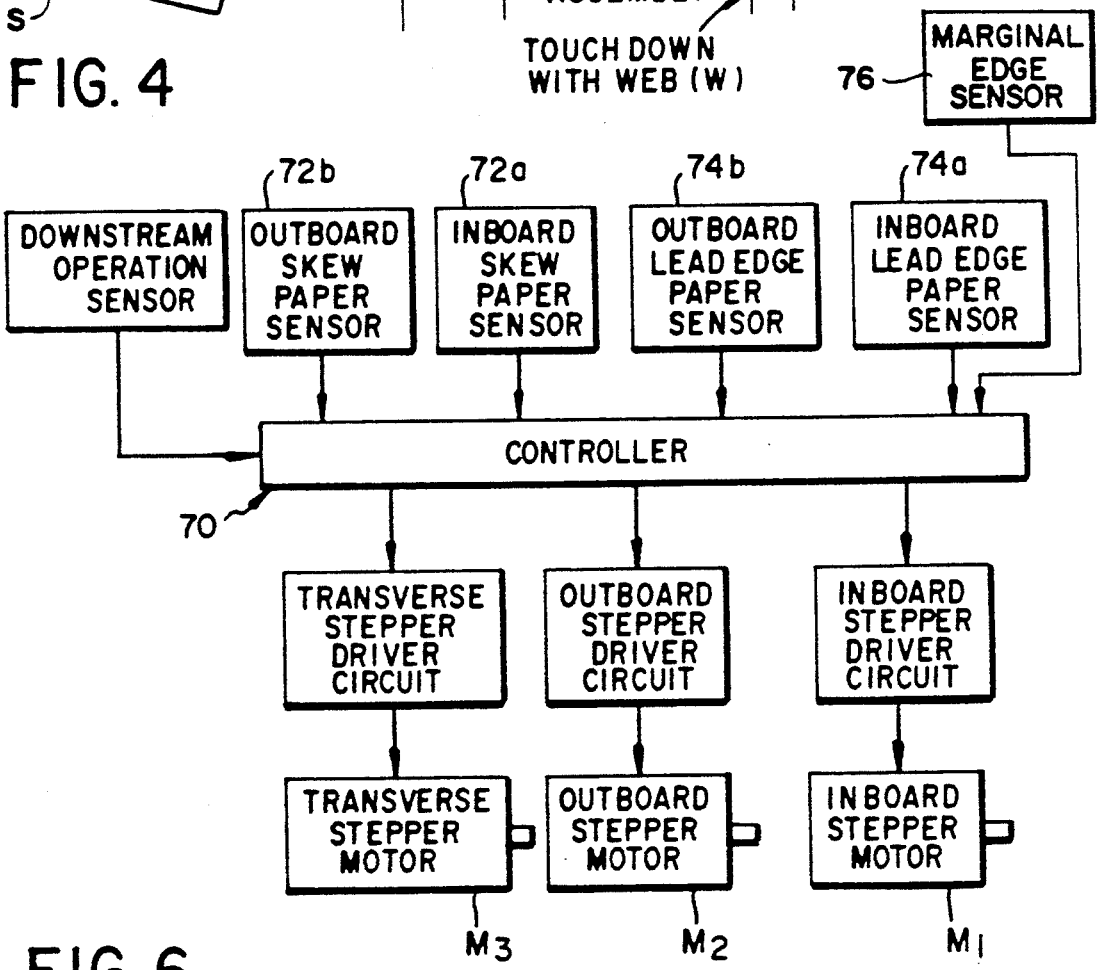
FIG. 6 is a schematic illustration of the control for the sheet registration mechanism according to this invention.

In order to effect the desired skew removal, and cross-track and in-track sheet alignment, the mechanical elements of the sheet registration mechanism 10 according to this invention are operatively associated with a logic and control unit 70 (see FIG. 6). The control unit 70 is, for example, a microprocessor base controller receiving input signals from a plurality of sensors associated with the sheet registration mechanism and the downstream operation station. Based on such signals and a program for the microprocessor, the control unit 70 produces appropriate signals to control the independent stepper motors $M_1$, $M_2$, and $M_3$ of the sheet registration mechanism. The production of a program for a number of commercially available microprocessors is a conventional skill well understood in the art. The particular details of any such program would, of course, depend on the architecture of the designated microprocessor.

For the operation of the sheet registration mechanism 10, referring now particularly to FIGS. 4–6 and 7*a*–7*f*, a sheet S traveling along the transport path P is moved into the vicinity of the sheet registration mechanism by an upstream transport assembly (not shown). Such sheet may be oriented at an angle (e.g., angle A in FIG. 4) to the centerline $C_L$ of the path P and may have its center A spaced a distance from the path centerline (e.g., distance d in FIG. 4). The angle $\alpha$ and distance d, which are undesirable, are of course generally induced by the nature of the upstream transport assembly and are variable sheet-to-sheet.

Figure 4:
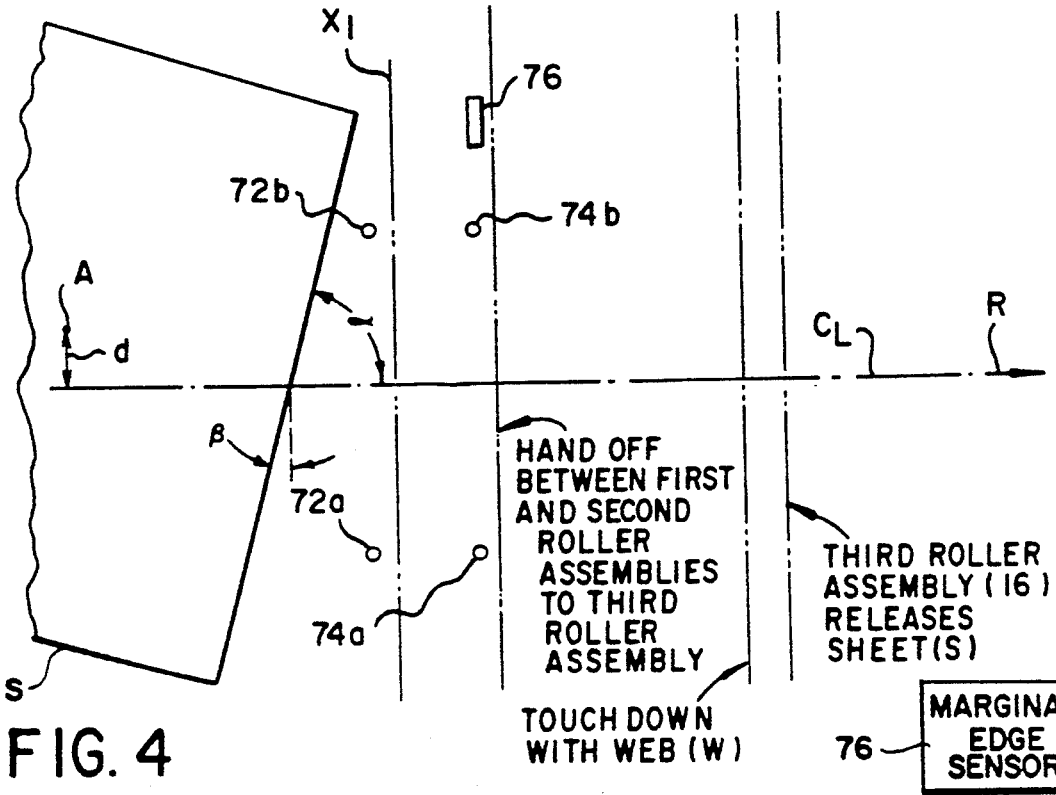
FIG. 4 is a top schematic illustration of the sheet transport path showing the actions of the sheet registration mechanism according to this invention on an individual sheet as it is transported along such transport path.

A first pair of sensors 72*a*, 72*b* is located upstream of the plane $X_1$ (see FIG. 4). The plane $X_1$ is defined as including the longitudinal axes of the urging rollers (24, 34, 48) and the rollers of the idler roller pairs (66, 68). The sensors 72*a*, 72*b* may, for example, be of either the optical or mechanical type. Sensor 72*a* is located to one side (in the cross-track direction) of the centerline $C_L$, while sensor 72b is located a substantially equal distance to the opposite side of the centerline $C_L$.

When the sensor 72a detects the lead edge of a sheet transported along the path P, it produces a signal which is sent to the logic and control unit 70 for the purpose of activating the first stepper motor $M_1$. In a like manner, when the sensor 72b detects the lead edge of a sheet transported along the path P, it produces a signal which is sent to the logic and control unit 70 for the purpose of activating the second stepper motor $M_2$. If the sheet S is at all skewed relative to the path P, the lead edge to one side of the centerline $C_L$ will be detected prior to detection of the lead edge at the opposite side of the centerline (of course, with no skew, the lead edge detection at opposite sides of the centerline will occur substantially simultaneously).

Figure 5:
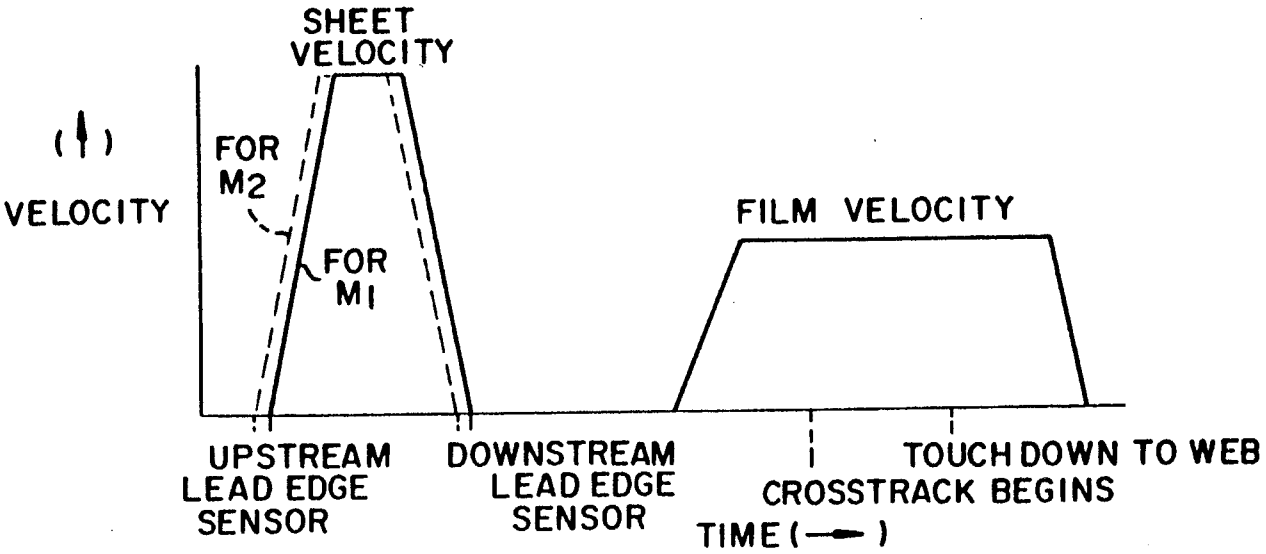
FIG. 5 is a graphical representation of the peripheral velocity profile over time for the urging rollers of the sheet registration mechanism according to this invention.

As shown in FIG. 5, when the first stepper motor $M_1$ is activated by the logic and control unit 70, it will ramp up to a speed such that the first urging roller 24 will be rotated at an angular velocity to yield a predetermined peripheral speed for the arcuate peripheral segment 24a of such roller substantially equal to the speed of a sheet transported along the path P. When the portion of the sheet S enters the nip between the arcuate peripheral segment 24a of the first urging roller 24 and the associated roller of the idler roller pair 66, such sheet portion will continue to be transported along the path P in a substantially uninterrupted manner (see FIG. 7b).

Likewise, when the second stepper motor $M_2$ is activated by the logic and control unit 70, it will ramp up to a speed such that the second urging roller 34 will be rotated at an angular velocity (substantially the same as the angular velocity of the first urging roller) to yield a predetermined peripheral speed for the arcuate peripheral segment 34a of such roller substantially equal to the speed of a sheet transported along the path P. When the portion of the sheet S enters the nip between the arcuate peripheral segment 34a of the second urging roller 34 and the associated roller of the idler roller pair 66, such sheet portion will continue to be transported along the path P in a substantially uninterrupted manner. As seen in FIG. 4, due to the angle a of the sheet S, sensor 72b will detect the sheet lead edge prior to the detection of the lead edge by the sensor 72a. Accordingly, the stepper motor $M_2$ will be activated prior to activation of the motor $M_1$.

A second pair of sensors 74a, 74b is located downstream of the plane $X_1$. As such, the sensors 74a, 74b are located downstream of the nips formed respectively by the arcuate peripheral segments 24a, 34a and their associated rollers of the idler roller pairs 66. Thus, the sheet S will be under the control of such nips. The sensors 74a, 74b may, for example, be of either the optical or mechanical type. Sensor 74a is located to one side (in the cross-track direction) of the centerline $C_L$, while sensor 74b is located a substantially equal distance to the opposite side of the centerline $C_L$.

When the sensor 74a detects the lead edge of a sheet transported along the path P by the urging roller 24, it produces a signal which is sent to the logic and control unit 70 for the purpose of deactivating the first stepper motor $M_1$. In a like manner, when the sensor 74b detects the lead edge of a sheet transported along the path P by the urging roller 34, it produces a signal which is sent to the logic and control unit 70 for the purpose of deactivating the second stepper motor $M_2$. Again, if the sheet S is at all skewed relative to the path P, the lead edge at one side of the centerline $C_L$ will be detected prior to detection of the lead edge at the opposite side of the centerline.

Figure 7A:
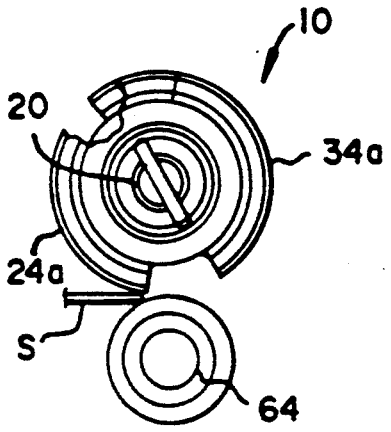
FIGS. 7*a*–7*f* are respective side elevational views of the urging rollers of the sheet registration mechanism according to this invention at various time intervals in the operation of the sheet registration mechanism.
Figure 7B:
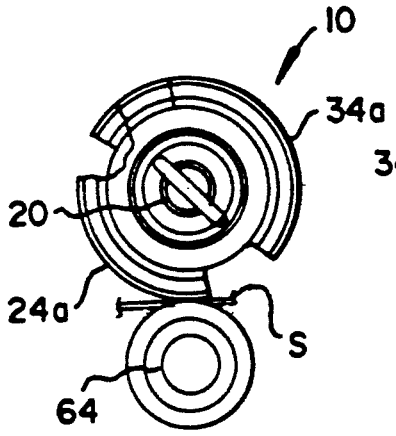
Figure 7C:
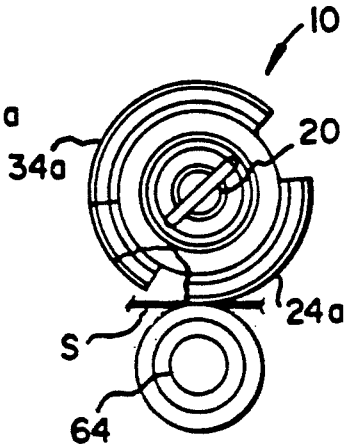
Figure 7D:
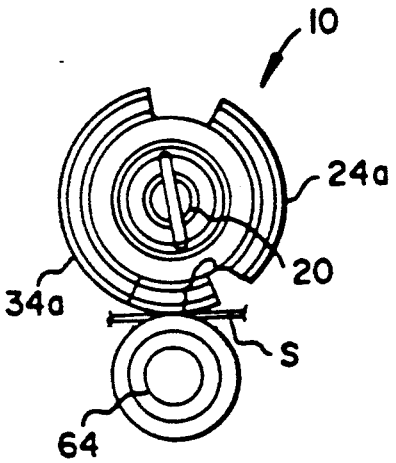
Figure 7E:
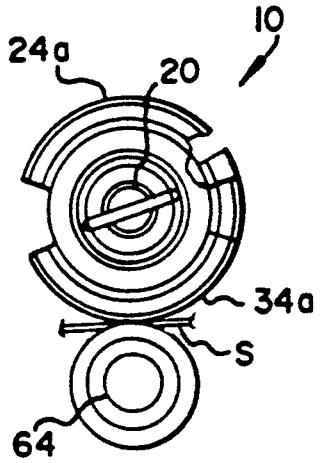
Figure 7F:
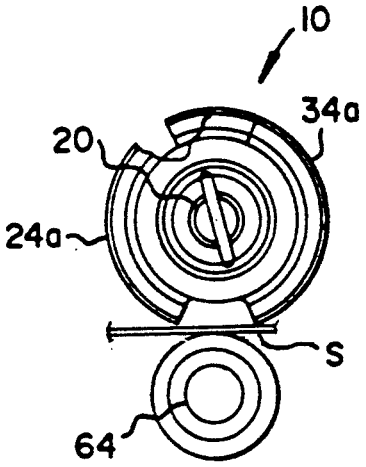

When the first stepper motor $M_1$ is deactivated by the logic and control unit 70, its speed will ramp down to a stop such that the first urging roller 24 will have zero angular velocity to stop the engaged portion of the sheet in the nip between the arcuate peripheral segment 24a of the first urging roller 24 and the associated roller of the idler roller pair 66 (see FIG. 7c). Likewise, when the second stepper motor $M_2$ is deactivated by the logic and control unit 70, its speed will down to a stop such that the first urging roller 24 will have zero angular velocity to stop the engaged portion of the sheet in the nip between the arcuate peripheral segment 34a of the second urging roller 34 and the associated roller of the idler roller pair 66. Again referring to FIG. 4, due to the angle $\alpha$ of the sheet S, sensor 74b will detect the sheet lead edge prior to the detection of the lead edge by the sensor 74a. Accordingly, the stepper motor $M_2$ will be deactivated prior to deactivation of the motor $M_1$. Therefore, the portion of the sheet in the nip between the arcuate peripheral segment 34a of the second urging roller 34 and the associated roller of the idler roller pair 66 will be held substantially fast (i.e., will not be moved in the direction along the transport path P) while the portion of the sheet in the nip between the arcuate peripheral segment 24a of the first urging roller 24 and the associated roller of the idler roller pair 66 continues to be driven in the forward direction. As a result, the sheet S will rotate substantially about its center A until the motor $M_1$ is deactivated. Such rotation, through an angle $\beta$ (substantially complementary to the angle $\alpha$) will square up the sheet and remove the skew in the sheet relative to the transport path P to properly align the lead edge thereof.

Once the skew has been removed from the sheet, as set forth in the above description of the first portion of the operative cycle of the sheet registration mechanism 10, the sheet is ready for subsequent cross-track alignment and registered transport to a downstream location. A sensor 76, such as a set of sensors (either optical or mechanical as noted above with reference to other sensors of the registration mechanism 10) aligned in the cross-track direction (see FIG. 4), detects a lateral marginal edge of the sheet S and produces a signal indicative of the location thereof.

The signal from the sensor 76 is sent to the logic and control unit 70 where the program for the unit will determine the distance (e.g., distance d shown in FIG. 4) of the center A of the sheet from the centerline $C_L$ of the transport path P. Further, a signal from the downstream operation station, indicating that the station is ready to receive a sheet, is sent to the logic and control unit 70. This later signal may be based on the location of the lead edge of an image I carried by the web W (see FIG. 2), such that a sheet transported from its stopped location in the registration mechanism 10 at a speed substantially equal to the speed of movement of the web will arrive in contact with the web with the lead edge of the sheet properly in register in the in-track direction with the lead edge of the image on the web.

When the signal from the downstream operation station is received by the logic and control unit 70, the first stepper motor $M_1$ and the second stepper motor $M_2$ will be activated. The first urging roller 24 and the second urging roller 34 will then begin rotation to start the transport of the sheet toward the downstream direction (see FIG. 7*d*). The stepper motors will ramp up to a speed such that the urging rollers of the roller assemblies 12, 14, and 16 will be rotated at an angular velocity to yield a predetermined peripheral speed for the respective portions of the arcuate peripheral segments thereof. Such predetermined peripheral speed is, for example, substantially equal to the speed of the web W. While other predetermined peripheral speeds are suitable, it is important that such speed be substantially equal to the speed of the web W when the sheet S touches down at the web.

Of course, in view of the above coupling arrangement for the third roller assembly 16, rotation of the third urging rollers 48 will also begin when the first stepper motor $M_1$ is activated. As will be appreciated from FIGS. 7*a*–7*d*, up to this point in the operative cycle of the sheet registration mechanism 10, the arcuate peripheral segments 48*a* of the third urging rollers 48 are out of contact with the sheet S and have no effect thereon. Now the arcuate peripheral segments 48*a* engage the sheet (in the nip between the arcuate peripheral segments 48*a* and the associated rollers of the idler roller pair 68) and, after a degree of angular rotation, the arcuate peripheral segments 24*a* and 34*a* of the respective first and second urging rollers leave contact with the sheet (see FIG. 7*e*). The control over the sheet is thus handed off from the nips established by the arcuate peripheral segments of the first and second urging rollers and the idler roller pair 66 to the arcuate peripheral segments of the third urging rollers and the idler roller pair 68 such that the sheet is under control of only the third urging rollers 48 for transport of the sheet along the path P.

At a predetermined time, once the sheet is solely under the control of the third urging rollers 48, the logic and control unit 70 activates the third stepper motor $M_3$. Based on the signal received from sensor 76 and the program of the unit 70, the stepper motor $M_3$ will drive the third roller assembly 16, through the above-described belt and pulley arrangement 50, in an appropriate direction and for an appropriate distance in the cross-track direction. Accordingly, the sheet in the nips between the arcuate peripheral segments of the third urging rollers 48 and the associated rollers of the idler roller pair 68 is urged in a cross-track direction to a location where the center A of the sheet coincides with the centerline $C_L$ of the transport path P to provide for the desired cross-track alignment of the sheet. It should be pointed out that if the cross-track alignment required to bring the sheet center into coincidence with the path centerline exceeds the range of movement possible for the roller assembly 16, the assembly will move to its maximum and forward the sheet in that location. Therefore, the sheet registration mechanism 10 will still continue to function (with somewhat degraded registration in the cross-track direction) and will not result in a hard shutdown of the mechanism and the apparatus with which it is associated.

The third urging rollers 48 continue to transport the sheet along the transport path P at a speed substantially equal to the speed of the web W until the lead edge touches down on the web, in register with the image I carried by the web. At this point in time, the angular rotation of the third urging rollers 48 brings the arcuate peripheral segments 482 of such rollers out of contact with the sheet S (see FIG. 7*f*). Since the arcuate peripheral segments 24*a* and 34*a* of the respective first and second urging rollers 24 and 34 are also out of contact with the sheet, such sheet is free to track with the web W undisturbed by any forces which might otherwise have been imparted to the sheet by any of the urging rollers.

At the time the first, second and third urging rollers are all out of contact with the sheet, the stepper motors $M_1$, $M_2$, and $M_3$ are activated for a time, dependent upon signals to the logic and control unit 70 from the respective sensors 30, 40, and 62, and then deactivated. As described above, such sensors are home position sensors. Accordingly, when the stepper motors are deactivated, the first, second, and third urging rollers are respectively located in their home positions. Therefore, the roller assemblies 12, 14, 16 of the sheet registration mechanism 10 according to this invention are located as shown in FIG. 7*a*, and the sheet registration mechanism is ready to provide skew correction and cross-track and in-track alignment for the next sheet transported along the path P.

The invention has been described in detail with particular reference to the preferred embodiment thereof, but it will be understood that variations and modifications can be effected within the spirit and scope of the invention as set forth in the claims.

What is claimed is:

1. A sheet registration mechanism for aligning a sheet moving along a substantially planar transport path relative to such transport path in a plurality of orthogonal directions, said sheet registration mechanism comprising:.

a first roller assembly rotatable about an axis lying in a plane parallel to the plane of said transport path, and substantially perpendicular to the direction of sheet travel along said transport path;

a second roller assembly rotatable about an axis lying in a plane parallel to the plane of said transport path, and substantially perpendicular to the direction of sheet travel along said transport path;

a third roller assembly rotatable about an axis lying in a plane parallel to the plane of said transport path, and substantially perpendicular to the direction of sheet travel along said transport path, and movable along its axis of rotation in a direction transverse to said transport path; and control means, operatively associated respectively with said first, second and third roller assemblies for selectively controlling rotation of said first and second roller assemblies to align a moving sheet in a direction perpendicular to said plane of said transport path, and for selectively controlling rotation of said third roller assembly and movement of said third roller assembly to align such moving sheet in the direction transverse to said transport path and in the direction of sheet travel along said transport path.

2. The sheet registration mechanism of claim 1 wherein said first roller assembly includes a first urging roller having an arcuate peripheral segment extending about a portion thereof for about 180° and wherein said second roller assembly includes a second urging roller having an arcuate peripheral segment extending about a portion thereof for about 180°.

3. The sheet registration mechanism of claim 1 wherein said third roller assembly includes at least a pair of third urging rollers respectively having an arcuate peripheral segment, extending about a portion thereof for about 180°.

4. The sheet registration mechanism of claim 1 wherein said first roller assembly includes a first urging roller having an arcuate peripheral segment extending about a portion thereof for about 180°, wherein said second roller assembly includes a second urging roller having an arcuate peripheral segment extending about a portion thereof for about 180°, and wherein said third roller assembly includes at least a pair of third urging rollers respectively having an arcuate peripheral segment extending about a portion thereof for about 180°.

5. The sheet registration mechanism of claim 4 wherein said arcuate peripheral segments of said first and second urging rollers are angularly coincident, and said arcuate peripheral segments of said third urging rollers are angularly offset from said arcuate peripheral segments of said first and second urging rollers.

6. The sheet registration mechanism of claim 5 further including a first shaft, said first urging roller being mounted on said first shaft for rotation therewith, and a second shaft, said second urging roller being mounted on said second shaft for rotation therewith.

7. The sheet registration mechanism of claim 6 wherein said third urging rollers are mounted on said first shaft for rotation therewith and for relative movement together along said first shaft.

8. The sheet registration mechanism of claim 7 wherein said first shaft and said second shaft are substantially coaxial.

9. The sheet registration mechanism of claim 8 wherein said first urging roller is mounted on said first shaft a predetermined distance on one side of the centerline of said transport path, and said second roller is mounted on said second shaft a substantially equal distance on the opposite side of the centerline of said transport path.

10. The sheet registration mechanism of claim 9 further including a first stepper motor operatively coupled to said first shaft for rotating said first shaft when said first stepper motor is activated, and a second independent stepper motor operatively coupled to said second shaft for rotating said second shaft when said second stepper motor is activated.

11. The sheet registration mechanism of claim 10 further including a third stepper motor operatively coupled to said third roller assembly for moving said third roller assembly along said first shaft when said third stepper motor is activated.

12. The sheet registration mechanism of claim 9 further including a first stepper motor operatively coupled to said first shaft for rotating said first shaft when said first stepper motor is activated, a second independent stepper motor operatively coupled to said second shaft for rotating said second shaft when said second stepper motor is activated, and a third independent stepper motor operatively coupled to said third roller assembly for moving said third roller assembly along said first shaft when said third stepper motor is activated.

13. The sheet registration mechanism of claim 12 further including a pair of upstream sensors respectively located on opposite sides of the centerline of said transport path, said upstream sensors respectively detecting the lead edge of a sheet traveling along said transport path and producing a signal indicative of such lead edge detection, and a pair of downstream sensors respectively located on opposite sides of the centerline of said transport path, said downstream sensors respectively detecting the lead edge of a sheet traveling along said transport path and producing a signal indicative of such lead edge detection.

14. The sheet registration mechanism of claim 13 wherein said control means includes means, responsive to said signals produced by said upstream sensors, for respectively activating said first stepper motor and said second stepper motor, and, responsive to said signals produced by said downstream sensors, for respectively deactivating said first stepper motor and said second stepper motor.

15. The sheet registration mechanism of claim 14 further including an edge sensor located for detecting a lateral marginal edge of a sheet in said transport path and producing a signal indicative of the position of such lateral marginal edge.

16. The sheet registration mechanism of claim 15 wherein said control means includes means, responsive to a signal from a downstream operation station, for reactivating at least said first stepper motor.

17. The sheet registration mechanism of claim 16 wherein said control means includes means, responsive to said signal produced by said edge sensor, for activating said third stepper motor for a predetermined time based on such signal.

18. The sheet registration mechanism of claim 17 further including a plurality of home sensors respectively associated with said first, second, and third roller assemblies, said home sensors respectively producing a signal indicative of its associated roller assembly being in its home position.

19. The sheet registration mechanism of claim 18 wherein said control means includes means, responsive to said signals produced by said home sensors, for respectively deactivating said first, second, and third stepper motors to assure location of said first, second, and third roller assemblies in their respective home positions.

20. A sheet registration mechanism for aligning a sheet moving along a substantially planar transport path relative to such transport path in a plurality of orthogonal directions, said sheet registration mechanism comprising:

a first roller assembly including a first urging roller mounted for rotation about an axis lying in a plane parallel to the plane of said transport path, and substantially perpendicular to the direction of sheet travel along said transport path;

means for rotating said first urging roller about its axis of rotation;

a second roller assembly including a second urging roller mounted for rotation about an axis lying in a plane parallel to the plane of said transport path, and substantially perpendicular to the direction of sheet travel along said transport path;

means for rotating said second urging roller about its axis of rotation;

a third roller assembly including a third urging roller mounted for rotation about an axis lying in a plane parallel to the plane of said transport path, and substantially perpendicular to the direction of sheet travel along said transport path, and movable along its axis of rotation in a direction transverse to said transport path;

means for rotating said third urging roller about its axis of rotation;

means for moving said third roller assembly along its axis of rotation; and control means, operatively associated respectively with said means for rotating said first, second and third urging rollers, and with said means for moving said third urging roller assembly, for selectively controlling rotation of said first and second urging rollers to align a moving sheet in a direction perpendicular to said plane of said transport path, and for selectively controlling rotation of said third urging roller and movement of said third urging roller assembly to align such moving sheet in the direction transverse to said transport path and in the direction of sheet travel along said transport path.

21. The sheet registration apparatus of claim 20 wherein said first urging roller is fixed on a first shaft, and said second urging roller is fixed on a second shaft coaxially aligned with said first shaft.

22. The sheet registration apparatus of claim 21 wherein said means for rotating said first urging roller is a first stepper motor operatively associated with said first shaft, and said means for rotating said second urging roller is a second stepper motor operatively associated with said second shaft.

23. The sheet registration apparatus of claim 22 wherein said third roller assembly is supported on said first shaft, and wherein said third roller assembly includes means for coupling said third roller assembly to said first shaft for rotation therewith and for movement relative to said first shaft in a direction along the axis thereof.

24. The sheet registration mechanism of claim 23 wherein said first urging roller has an arcuate peripheral segment extending about a portion thereof for about 180°, wherein said second urging roller has an arcuate peripheral segment extending about a portion thereof for about 180°, and wherein said third urging rollers respectively have an arcuate peripheral segment extending about a portion thereof for about 180°.

25. The sheet registration mechanism of claim 24 wherein said first urging roller is mounted on said first shaft a predetermined distance on one side of the centerline of said transport path, and said second roller is mounted on said second shaft a substantially equal distance on the opposite side of the centerline of said transport path.

26. The sheet registration mechanism of claim 25 further including a third independent stepper motor operatively coupled to said third roller assembly for moving said third roller assembly along said first shaft when said third stepper motor is activated.

27. The sheet registration mechanism of claim 26 further including a pair of upstream sensors respectively located o: opposite sides of the centerline of said transport path, said upstream sensors respectively datecting the lead edge of a sheet traveling along said transport path and producing a signal indicative of such lead edge detection, and a pair of downstream sensors respectively located on opposite sides of the centerline of said transport path, said downstream sensors respectively detecting the lead edge of a sheet traveling along said transport path and producing a signal indicative of such lead edge detection.

28. The sheet registration mechanism of claim 27 wherein said control means includes means, responsive to said signals produced by said upstream sensors, for respectively activating said first stepper motor and said second stepper motor, and, responsive to said signals produced by said downstream sensors, for respectively deactivating said first stepper motor and said second stepper motor.

29. The sheet registration mechanism of claim 28 further including an edge sensor located for detecting a lateral marginal edge of a sheet in said transport path and producing a signal indicative of the position of such lateral marginal edge.

30. The sheet registration mechanism of claim 29 wherein said control means includes means, responsive to a signal from a downstream operation station, for reactivating at least said first stepper motor.

31. The sheet registration mechanism of claim 30 wherein said control means includes means, responsive to said signal produced by said edge sensor, for activating said third stepper motor for a predetermined time based on such signal.

32. The sheet registration mechanism of claim 31 further including a plurality of home sensors respectively associated with said first, second, and third roller assemblies, said home sensors respectively producing a signal indicative of its associated roller assembly being in its home position.

33. The sheet registration mechanism of claim 32 wherein said control means includes means, responsive to said signals produced by said home sensors, for respectively deactivating said first, second, and third stepper motors to assure location of said first, second, and third roller assemblies in their respective home positions.

34. A method for aligning a sheet moving along a substantially planar transport path relative to such transport path in a plurality of orthogonal directions, said sheet alignment method comprising the steps of:

(a) on one side of the centerline of the substantially planar transport path, detecting the lead edge of a sheet moving along such transport path;

(b) urging such sheet at said one side of the centerline of such transport path in a direction along such transport path;

(c) on the opposite side of the centerline of the substantially planar transport path, detecting the lead edge of a sheet moving along such transport path;

(d) urging such sheet at said opposite side of the centerline of such transport path in a direction along such transport path;

(e) after a predetermined travel of such sheet at said one side of the centerline of such transport path, stopping such sheet;

(f) after a predetermined travel of such sheet at said opposite side of the centerline of such transport path, stopping such sheet, whereby such sheet will be squared up with respect to said transport path;

(g) at a predetermined time based on a desired downstream operation to be performed on such sheet, urging such sheet along said transport path in timed relation to such downstream operation; and (h) as such sheet is traveling in a direction along said transport path, urging such sheet in a direction transverse to said transport path to align the centerline of such sheet with the centerline of said transport path.

35. In a sheet registration mechanism having a plurality of urging means located in spaced relation in a direction transverse to a substantially planar transport path with independent urging means located respectively on each side of the centerline of such transport path and urging means located to span the centerline of such transport path, and independent drive means for said respective urging means, a method for aligning a sheet moving along such transport path relative to such transport path in a plurality of orthogonal directions, said sheet alignment method comprising the steps of:

(a) in response to the detection of the lead edge of a sheet moving along such transport path on one side of the centerline of such transport path, activating the drive means for the associated urging means on that side of the centerline of such transport path;

(b) in response to the detection of the lead edge of a sheet moving along such transport path on the opposite side of the centerline of such transport path from said aforementioned one side of the centerline of such transport path, activating the drive means for the associated urging means on that opposite side of the centerline of such transport path;

(c) in response to the detection of the lead edge of a sheet urged along such transport path on one side of the centerline of such transport path a predetermined distance from lead edge detection of step (a), deactivating the drive means for the associated urging means on that side of the centerline of such transport path;

(d) in response to the detection of the lead edge of a sheet moving along such transport path on the opposite side of the centerline of such transport path from said aforementioned one side of the centerline of such transport path a predetermined distance from lead edge detection of step (b), deactivating the drive means for the associated urging means on that opposite side of the centerline of such transport path, whereby such sheet will be squared up with respect to said transport path;

(e) in response to a signal from a downstream operation station, activating said drive for said urging means spanning the centerline of such transport path to urge such sheet in a direction along such transport path in timed relation to such downstream operation; and (f) as such sheet is urged in a direction along said transport path by said urging means spanning the centerline of such transport path, activating said drive means for said urging means spanning the centerline of such transport path to urging such sheet in a direction transverse to such transport path to align the centerline of such sheet with the centerline of such transport path.

* * * * *

UNITED STATES PATENT AND TRADEMARK OFFICE

CERTIFICATE OF CORRECTION

PATENT NO. : 5,322,273
DATED : June 21, 1994
INVENTOR(S) : Alan E. Rapkin, et. al.

It is certified that error appears in the above-indentified patent and that said Letters Patent is hereby corrected as shown below:

| | |
|---|---|
| Column 12, line 12 | After "sensor" insert ---, said edge sensor---. |
| Column 13, line 53 | Delete "o:" and substitute ---on---. |
| Column 13, line 54, | Delete "datecting" and substitute ---detecting---. |
| Column 14, line 4 | After "sensor" insert ---, said edge sensor---. |

Signed and Sealed this

Twenty-fourth Day of January, 1995

*Attest:*

Bruce Lehman

BRUCE LEHMAN

*Attesting Officer*

*Commissioner of Patents and Trademarks*